US009175690B2

(12) United States Patent
Schütz et al.

(10) Patent No.: US 9,175,690 B2
(45) Date of Patent: Nov. 3, 2015

(54) COMPRESSOR

(75) Inventors: Gottfried Schütz, Tutzing (DE); Sven-J. Hiller, Röhrmoos (DE); Yves Burgold, München (DE)

(73) Assignee: MTU AERO ENGINES GmbH, Munich (DE)

( * ) Notice: Subject to any disclaimer, the term of this patent is extended or adjusted under 35 U.S.C. 154(b) by 534 days.

(21) Appl. No.: 13/123,951

(22) PCT Filed: Oct. 16, 2009

(86) PCT No.: PCT/DE2009/001437

§ 371 (c)(1),
(2), (4) Date: Apr. 13, 2011

(87) PCT Pub. No.: WO2010/045923

PCT Pub. Date: Apr. 29, 2010

(65) Prior Publication Data

US 2011/0200470 A1 Aug. 18, 2011

(30) Foreign Application Priority Data

Oct. 20, 2008 (DE) ..... 10 2008 052 372

(51) Int. Cl.
*F04D 27/02* (2006.01)

(52) U.S. Cl.
CPC ..... *F04D 27/0215* (2013.01); *F05B 2260/601* (2013.01); *F05B 2270/10812* (2013.01)

(58) Field of Classification Search
CPC . F04D 27/02; F04D 27/0207; F04D 27/0238; F04D 27/0215
USPC ..... 415/115, 58.5, 914, 57.1, 57.3–57.4, 415/58.7, 185, 186, 208.2, 208.3, 208.5
See application file for complete search history.

(56) References Cited

U.S. PATENT DOCUMENTS

| | | | | | |
|---|---|---|---|---|---|
| 2,685,429 | A * | 8/1954 | Auyer | 415/110 |
| 2,702,157 | A * | 2/1955 | Stalker | 415/48 |
| 2,958,456 | A | 11/1960 | Forshaw | |
| 3,462,071 | A * | 8/1969 | Garve | 415/116 |
| 4,303,371 | A * | 12/1981 | Eckert | 415/116 |
| 4,732,531 | A * | 3/1988 | Minoda et al. | 415/115 |
| 5,059,093 | A * | 10/1991 | Khalid et al. | 415/115 |
| 5,340,271 | A | 8/1994 | Freeman et al. | |
| 5,586,859 | A * | 12/1996 | Nolcheff | 415/58.5 |
| 5,607,284 | A * | 3/1997 | Byrne et al. | 415/58.5 |
| 6,585,479 | B2 * | 7/2003 | Torrance | 415/58.5 |
| 6,813,887 | B2 * | 11/2004 | Sumser et al. | 60/611 |
| 7,704,039 | B1 * | 4/2010 | Liang | 415/116 |
| 8,066,471 | B2 * | 11/2011 | Bayere et al. | 415/58.5 |
| 2006/0104805 | A1 * | 5/2006 | Gummer | 415/58.5 |

FOREIGN PATENT DOCUMENTS

| | | | | |
|---|---|---|---|---|
| DE | 69621079 T2 | | 1/2003 | |
| DE | EP1862641 | * | 12/2007 | F01D 5/14 |
| EP | 0537503 A1 | | 4/1993 | |

* cited by examiner

*Primary Examiner* — Richard Edgar
*Assistant Examiner* — Brian O Peters
(74) *Attorney, Agent, or Firm* — Barlow, Josephs & Holmes, Ltd.

(57) ABSTRACT

A compressor is disclosed, which has an inflow channel for guiding a compression medium into a compressor housing, a pressure chamber formed within the compressor housing, and a liner segment with nozzles that transport the compression medium from the pressure chamber to a rotor. The nozzles are formed in the liner segment as a plurality of nozzles arranged in a group in fan-like manner.

19 Claims, 9 Drawing Sheets

COMPRESSOR

TECHNICAL FIELD

The present invention relates to a compressor according to the preamble of claim 1. In addition, the present invention relates to a driving mechanism or engine having a compressor.

TECHNICAL PROBLEM

The basic structure of such a compressor is explained first.

FIG. 1 shows a schematic diagram of a compressor with injection as it is also known, e.g., in the prior art.

Such a compressor compresses a compression medium, whereby the pressure of the medium is thereby increased. In order to achieve high pressures, the compressor has several stages, which comprise alternately arranged rotors and stators.

The compressor has an outer housing 18, within which is disposed a housing segment 20, which in turn is disposed—as seen in the direction of flow—upstream of a rotor 30, which has blades. A pressure compensation chamber 12, the so-called plenum, is found between outer housing 18 and housing segment 20.

In the case of this compressor, an air current is introduced into pressure compensation chamber 12 via an air feed tube 10 disposed on outer housing 18, whereupon a high pressure builds up in this chamber 12. Air is injected into rotor 30 through nozzles accommodated in housing segment 20. A relatively low pressure prevails thereby in the rotor space. The rotor running direction is indicated in FIG. 1 by means of an arrow.

In addition, such a compressor has additional rotors and stators, which are not shown in FIG. 1.

With such a structure, there exists the danger of a flow separation for the flow in the compressor, since the flow of the compression medium must run up against increasing pressure. If a break in the flow occurs in one or in several stages of the compressor, a massive decrease in performance results in the compressor. The compressor then tends toward a so-called pumping, since the flow at the walls no longer possesses sufficient kinetic energy in order to overcome the pressure increase.

The onset of this so-called compressor pumping can be opposed by different measures. It is known that when a compressor is throttled, the compressor pumping can be delayed by injection in the region of the housing.

One measure is thus the configuration of deflecting nozzles, so-called injection nozzles, in the region of the housing edge (in the liner segments), which blow an introduced air flow to the rotor wall, whose blowing direction toward the rotor wall (parallel to the wall) is deflected—with swirling. This deflection of air flow in the nozzles is produced in the axial direction and in the circumferential direction of the compressor. The onset of compressor pumping can be clearly delayed by a specific configuration of the injection nozzles when compared to other conventional solutions.

These injection nozzles usually are made up of simple slots that pass through the liner segment so that the blow-out or discharge end is facing the rotor. In addition, round and flattened injection nozzles are also used.

The installation space for these deflecting injection nozzles, i.e., in the liner segment, is thus very limited and a high degree of deflection (strong deflection) results. The installation space also remains very limited in the case in which the nozzles are incorporated in the annular space (pressure chamber) found over this. Also, an additional obstruction is caused thereby and the deflection remains high.

In this way, in the case of conventional configurations, free jets are produced, whose dispersion behavior (i.e., direction, as well as velocity and swirling distributions) cannot be influenced at all or can be influenced only with difficulty.

Channels and nozzles with large cross-sectional surface and strong deflection thus tend to form strong three-dimensional cross flows within the nozzle core flow, which can lead to flow separation.

However, in these conventional injection nozzles, there is the problem that a strong spatial deflection, i.e., a large difference between the entrance angle and the exit angle of the injection nozzle can hardly be created, since strong cross flows would then result, which in turn lead to flow separations within the nozzle.

The backward effect of a crosswise directed external flow at the nozzle outlet on the nozzle core flow is very strong when the length to diameter ratio is small (approx. $1/d<3 \ldots 5$).

In addition, in the case of small nozzle cross sections, it is nearly impossible to integrate swirlers into the nozzle.

PROBLEM OF THE INVENTION

The problem of the present invention thus is to create an improved compressor, in which the injection is configured advantageously, and to create an improved driving mechanism or engine.

With regard to the compressor, this problem is solved by a compressor with the features of claim 1. With regard to the driving mechanism or engine, the problem is solved by a driving mechanism or engine with the features of claim 10.

Advantageous enhancements of the invention are the subject of the additional claims.

According to the compressor of the invention according to claim 1, there is provided a so-called fan-like nozzle having a plurality of small individual nozzles. In this construction, in comparison to the conventional slot solution, several small individual nozzles, which replace the slot, provide the injection into the rotor space. Disruptive cross flows can be much more easily avoided in the small individual nozzles. The individual nozzles are largely free of cross flows. A strong radial deflection and/or a strong circumferential deflection is thereby possible without producing premature flow separations.

In turn, the installation space of the nozzles can be made smaller in this way, and/or a greater deflection can be produced than in the conventional slot solution.

The compressor of the invention according to claim 2 makes possible the formation of a suitable deflection in the case of a small installation space in the liner segment. Since small individual nozzles (individual channels) are formed, a stronger deflection can still be selected in comparison to the conventional slot solution, without needing to fear cross flows.

The compressor of the invention according to claim 3 makes possible an advantageous inflow from the pressure chamber into the individual nozzles when there is small installation space, and supports a strong deflection in the nozzle.

In the compressor of the invention according to claim 4, there is increased flexibility of the application site.

The compressor of the invention according to claim 5 leads to an outflow similar to that of slots by utilizing the advantage of individual nozzles. A surface flow can be provided thereby.

The compressor of the invention according to claim 6 makes possible a high volume flow by utilizing the advantage of individual nozzles.

The compressor of the invention according to claim 7 makes possible an improvement of the flow behavior of the main flow in the rotor at the rotor wall.

The compressor of the invention according to claim 8 makes possible a flexible air delivery as desired in the compressor.

The compressor of the invention according to claim 9 makes possible a better protection against a break in the flow along the circumference of the compressor.

The compressor of the invention according to claim 10 makes possible a cost-effective production of the compressor.

The driving mechanism or engine of the invention according to claim 11 utilizes these compressor advantages.

The present invention is explained more precisely below based on embodiment examples. Drawings are attached to better illustrate several aspects of the embodiment examples.

DETAILED DESCRIPTION OF A PREFERRED EXAMPLE OF EMBODIMENT

An example of embodiment of the present invention is described below with reference to the drawings.

Figure 1:
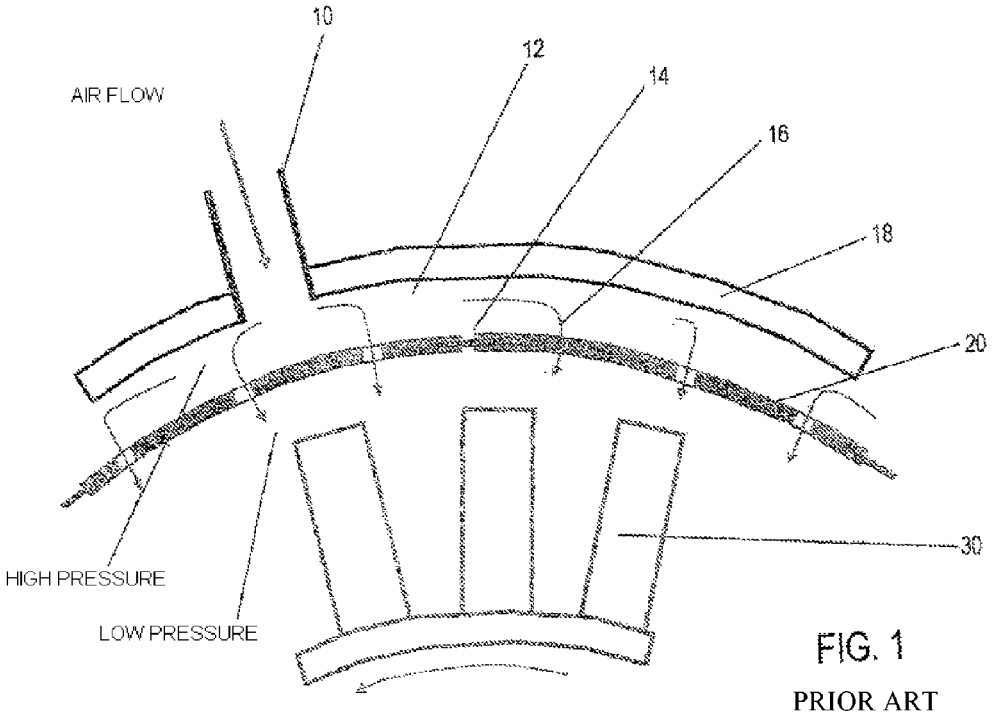
FIG. 1 PRIOR ART
FIG. 1 shows a schematic diagram of a compressor with injection as it is also known, e.g., in the prior art.
Figure 2:
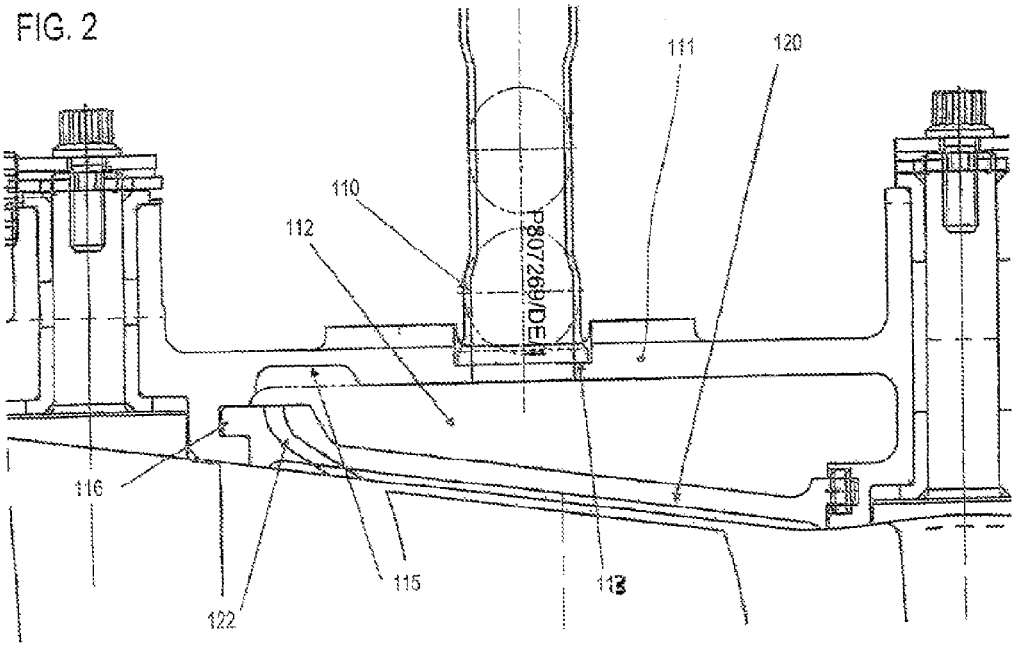
FIG. 2 shows a longitudinal section through a compressor according to the invention.

FIG. 2 shows a longitudinal section through a compressor according to the invention.

First, the general construction of the compressor according to the invention is described.

The compressor has an outer housing 111, within which a segment 120 (a so-called liner segment) is disposed, which is disposed upstream from a rotor (not shown), which has rotating blades. The so-called plenum 112 is found between outer housing 111 and liner segment 120. Liner segment 120 is engaged on outer housing 111 via a so-called housing hook 116. The end section of liner segment 120 is defined on housing hook 116. A pocket 115 is formed on outer housing 111 facing plenum 112 in the region of the end section of liner segment 120.

Formed in the end section of liner segment 120 are so-called injection channels 122 with nozzles 123 (see FIG. 8), whose entrance region faces pocket 115 of outer housing 111 and whose exit region faces the rotor (in FIG. 2, the rotating blade of the rotor is indicated below liner segment 120).

Nozzles 123 are provided as nozzle groups in the end section of liner segment 120. In the present example of embodiment, such a group of nozzles 123 is formed in the end section of liner segment 120 by five nozzles 123, which are aligned adjacent to one another in the circumferential direction of liner segment 120. Several groups of nozzles according to the invention can be provided at the liner segment.

Figure 3:
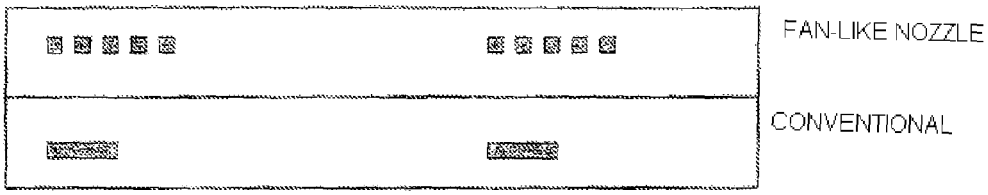
FIG. 3 shows a representation of a circumferential unwinding of a liner segment according to an example of embodiment of the present invention in comparison to a conventional construction.

FIG. 3 shows a representation of a circumferential unwinding of a liner segment 120 observed from the annular space onto the liner segment according to an example of embodiment of the present invention in comparison to a conventional construction. The group of five nozzles 123 of the present example of embodiment is thus formed as a so-called fan-like nozzle. As can be seen clearly in FIG. 3, the group of five nozzles 123 of the present example of embodiment corresponds to a conventional slot nozzle.

The mode of operation of the compressor according to the invention is described below.

In this compressor, an air flow is introduced into pressure chamber 112 (the so-called plenum) via an air feed pipe 110 disposed on outer housing 111 by means of flange 113. Air reaches the entrance region of nozzles 123 via pocket 115 and is injected into rotor 30 via the nozzle outlets.

Figure 4:
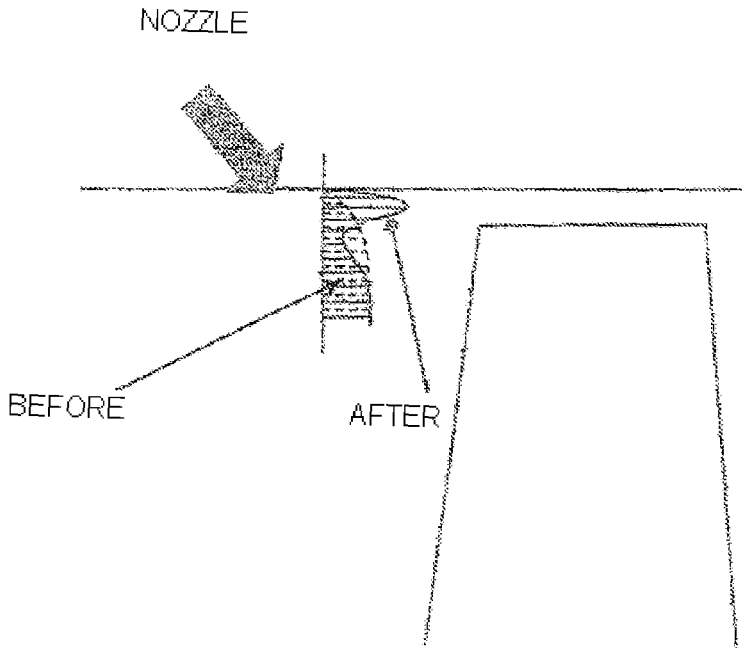
FIG. 4 shows velocity profiles.

FIG. 4 shows velocity profiles.

The velocity profile beforehand is shown by the dashed line, wherein the decrease in velocity of the compressor flow at the housing wall can be recognized. The velocity profile afterward is shown by the solid line. The increased velocity at the housing wall, which is caused by the fan-like nozzle according to the invention, can be recognized.

DETAILS OF THE EXAMPLE OF EMBODIMENT

Figure 5:
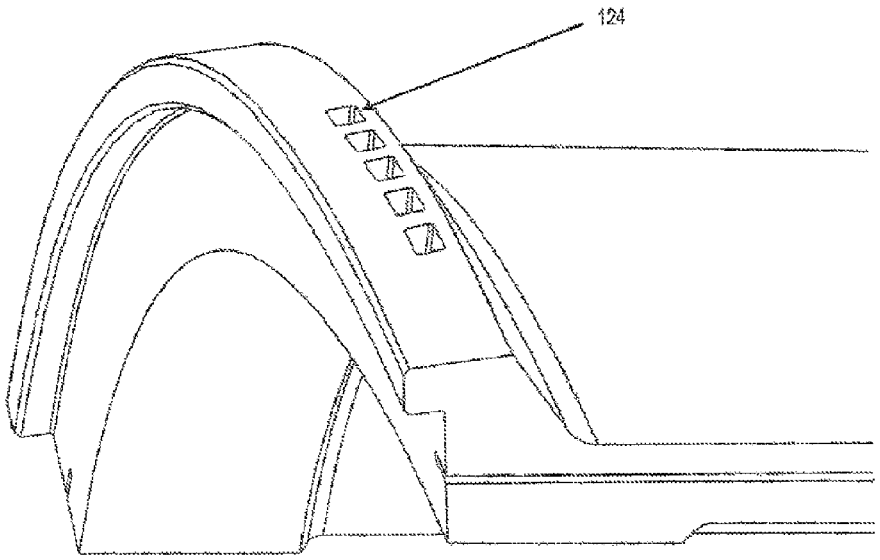
FIG. 5 shows a perspective representation in partial section of an end section of a liner segment according to the example of embodiment of the present invention, wherein the nozzle inlet is shown.

FIG. 5 shows a perspective representation in partial section of an end section of a liner segment according to the example of embodiment of the present invention, wherein the nozzle inlet is shown.

The entrance region of the group of nozzles 123 formed as a fan-like nozzle is formed on the upper side of the narrow liner segment that is facing plenum 112, so that it faces pocket 115 in housing 111. The five nozzles used in this embodiment example for the group of nozzles have a quadrilateral or square cross section in the entrance region.

Figure 6:
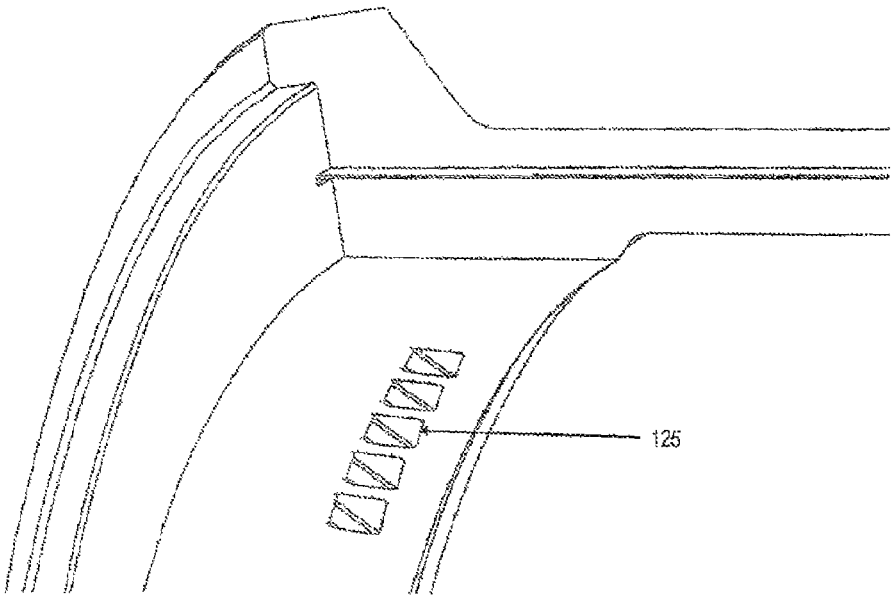
FIG. 6 shows a perspective representation in partial section of an end section of a liner segment according to the example of embodiment of the present invention, wherein the nozzle outlet is shown.

FIG. 6 shows a perspective representation in partial section of an end section of a liner segment according to the example of embodiment of the present invention, wherein the nozzle outlet is shown.

The outlet region of the group of nozzles 123 formed as a fan-like nozzle on the bottom side of the liner segment that is facing away from plenum 112 is formed so that it faces the rotor. The five nozzles used in this embodiment example for the group of nozzles have a quadrilateral or square cross section throughout from the entrance region down to the exit region.

Figure 7:
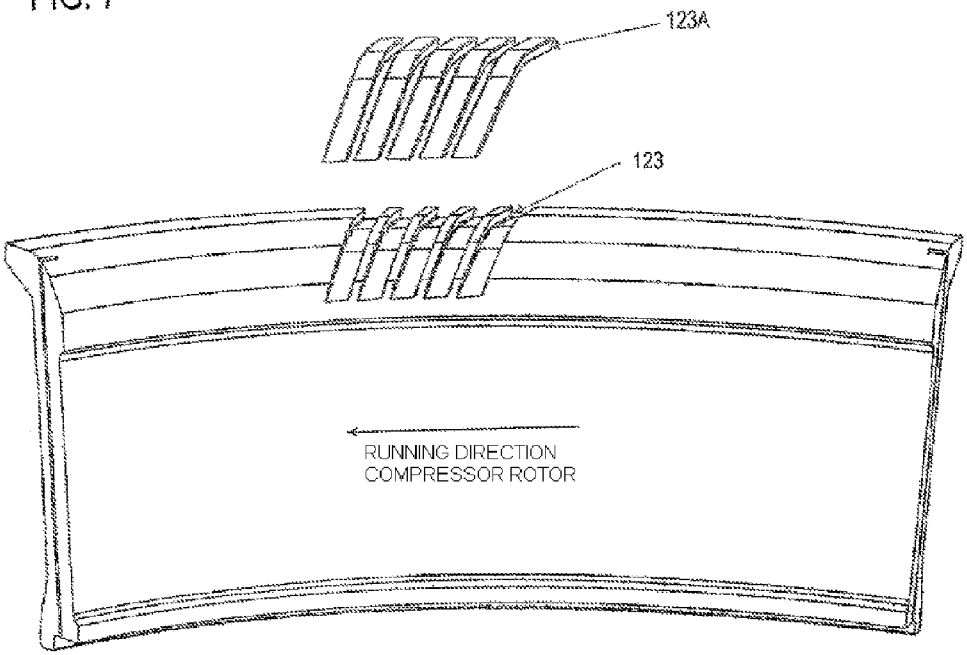
FIG. 7 shows a perspective sectional view of an end section of a liner segment according to the example of embodiment of the present invention, wherein the nozzles are shown in cutaway section.
Figure 8:
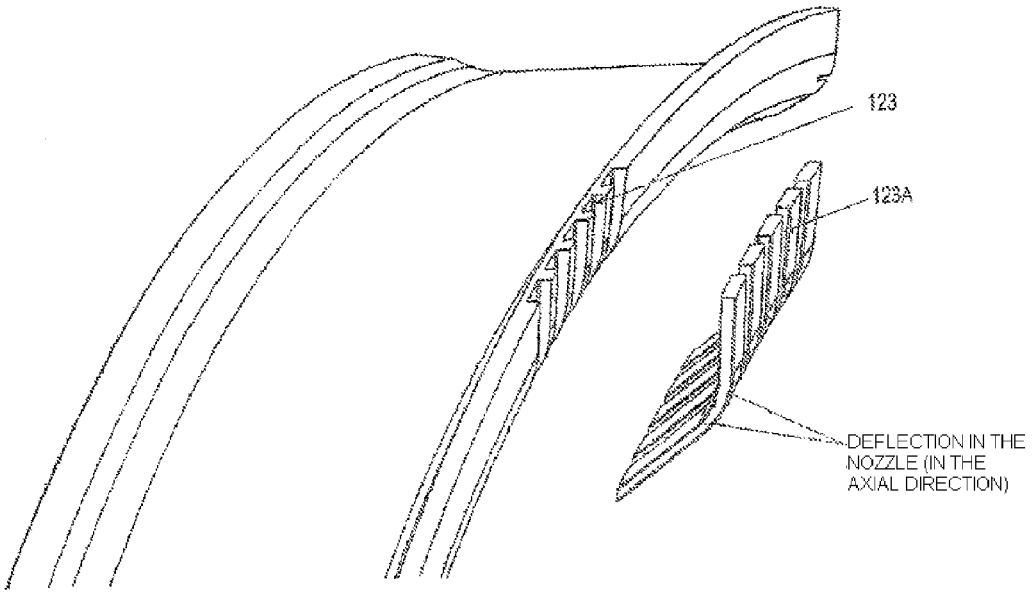
FIG. 8 shows a perspective sectional view of an end section of a liner segment according to the example of embodiment of the present invention, wherein the nozzles are shown in cutaway section, with observation from a direction other than that of FIG. 7.

FIGS. 7 and 8 each show perspective sectional views of the end section of a liner segment according to the example of embodiment of the present invention. The nozzles are shown in cutaway section in each case.

FIG. 8 thus shows a view with observation from a direction different from that of FIG. 7.

The many individual nozzles are disposed next to one another. According to the embodiment example, the wall space between two adjacent individual nozzles is in fact smaller than the width of an individual nozzle. The many individual nozzles thus form a compact configuration.

In FIGS. 7 and 8, not only is shown in cutaway section the group of nozzles (individual nozzles) 123 formed as a fan-like nozzle, but also the core of the fan-like nozzle in perspective with the reference number 123A. The deflection in the respective nozzle can be clearly seen here. The nozzle inlet stands at an angle to the nozzle outlet. In FIG. 8, the nozzle deflection is configured in the axial direction.

Figure 9:
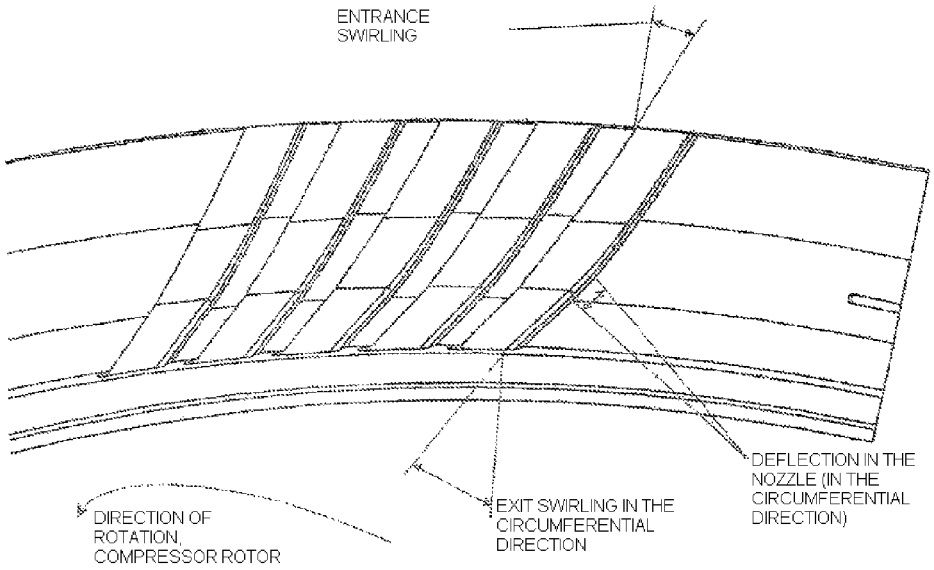
FIG. 9 shows a perspective sectional view for illustrating the nozzle deflection in the liner segment according to the example of embodiment of the present invention, wherein the nozzles are shown in cutaway section.

FIG. 9 shows a perspective sectional view for illustrating the nozzle deflection in the liner segment according to the example of embodiment of the present invention, wherein the nozzles are shown in cutaway section.

The entrance region of the respective nozzle 122* has an entrance swirling that results from the angle of the entrance region to the perpendicular of the tangent line at the nozzle inlet. The exit region of the respective nozzle 122* has an exit swirling that results from the angle of the exit region to the perpendicular of the tangent line at the nozzle outlet. As shown in FIG. 9, in this example of embodiment, the entrance swirling is smaller than the exit swirling. In nozzle 122*, the entrance region and the exit region meet up in the deflection region, in which the injection direction is deflected.

sic; nozzle 123? Translator's note.

sic; nozzle 123? Translator's note.

The fan-like nozzle according to the invention makes possible a production of the liner segment, e.g., as a casting or also by so-called rapid prototyping.

ADVANTAGES OF THE INVENTION

Instead of a single, strongly deflecting, individual nozzle, a group of several small individual nozzles is used, which provide the same deflection or a greater deflection.

Due to the compact configuration of the many individual nozzles, the total effect is comparable to the effect of a large individual nozzle (e.g., the conventional slot nozzle) in the vicinity of the nozzle. The entrance swirling reduces the necessary deflection and the structural space of the nozzle.

Based on the large ratio between length and cross section of the small-diameter individual nozzles according to the invention, these nozzles are largely free of disruptive cross flows.

The construction with individual channels makes possible almost any spatial arrangement of the individual nozzles, so that a great diversity of configurations corresponding to the most varied technical requirements results.

Thus, in contrast to a configuration with a conventional slot nozzle (see the comparison in FIG. 3), in the solution according to the present example of embodiment, a larger deflecting angle can be provided, i.e., a greater difference between entrance angle and exit angle can be provided, without a separation of flow or without having to fear a compressor pumping.

The additional pressure loss due to the greater wall friction (larger wetted surface) can be tolerated in many cases.

The fan-like nozzle according to the invention thus makes possible a strong radial deflection and/or circumferential deflection in the smallest space. Thus, it is best suitable for use in liner segments.

By means of a special configuration of the nozzle outlet openings 125 (radial offset, axial offset and/or circumferential offset), any desired distribution of velocity and swirling can be produced in the vicinity of the housing wall. That is, due to the spatial position (radial and/or axial gradation) of the nozzle outlet openings 125 to one another, a desired velocity profile or swirling profile of the air flow can be adjusted in the vicinity of the nozzle at the housing wall (e.g., a free jet with swirling). In the case of a radial-axial gradation with adjusted exit angle of the individual nozzles, a special velocity profile perpendicular to the wall can be adjusted as desired with injection flush with the wall.

In the case of a circumferential spread of the distribution of nozzle outlet openings 125 of individual nozzles 123, slot-shaped velocity distributions or a homogenization of jet velocities can be achieved in the circumferential direction.

The fan-like nozzle according to the invention in fact makes possible deflections that lead to an outlet injection flow which is directed approximately flush with the nozzle outlet wall.

Therefore, the above-named problem of flow separation is minimized in the fan-like nozzle according to the invention.

ALTERNATIVES

The flow cross section of the fan-like nozzles is formed in a quadrilateral shape in the above-described example of embodiment. Thus, it can assume a square or a rectangular shape. The rectangular shape facilitates a slot-like injection. In another example of embodiment, the flow cross section of the fan-like nozzles can be designed in oval or circular shape.

In the above-described example of embodiment, five individual nozzles 123 form a group of nozzles. A group of nozzles may also be formed, e.g., by three, four or six nozzles 123. The number is not limited as long as several individual nozzles are used.

In the above-described example of embodiment, as is particularly well shown in FIG. 8, the nozzle deflection is configured in the axial direction. The nozzle deflection may also be configured in the circumferential direction and/or in the axial direction.

In the above-described example of embodiment, the fan-like nozzle according to the invention is provided with an entrance swirling. The invention is not limited thereto. A fan-like nozzle according to the invention without an entrance swirling may also be provided.

The invention claimed is:

1. A compressor having an inflow channel (110), which guides a compression medium into a pressure chamber (112) formed inside a compressor housing (111), and a liner segment (120) with a plurality of groups of nozzles, each group of nozzles comprising a plurality of nozzles, and each nozzle (123) transports the compression medium from pressure chamber (112) to a rotor, the plurality of nozzles within each respective group of nozzles being aligned adjacent to one another in a circumferential direction of the liner segment, and the groups of nozzles being circumferentially spaced apart along the liner segment, is hereby characterized in that the pressure chamber (112) is positioned between the liner segment (120) and the compressor housing (111), each nozzle (123) has an entrance section (124) and an exit section (125), the entrance section extending linearly along an entrance axis, the exit section extending linearly along an exit axis, and the entrance axis and exit axis being at an angle to one another;

each nozzle (123) includes a deflection region located where the entrance section (124) and exit section (125) meet;

wherein each nozzle extends from a first side of the liner segment to a second side of the liner segment, so that the entrance section (124) is in facing relation with the compressor housing (111), and the exit section (125) is in facing relation with the rotor; and wherein each nozzle directs the compression medium in a downstream direction.

2. The compressor according to claim 1, further characterized in that each nozzle (123) has an entrance section (124) with an entrance swirling.

3. The compressor according to claim 1, further characterized in that each nozzle (123) has an entrance section (124) that is perpendicular to a tangent line of the liner segment at the entrance section.

4. The compressor according to claim 1, further characterized in that each nozzle has a nozzle outlet wall; and exit section (125) is configured such that the deflection region between entrance section (124) and exit section (125) leads to an exit injection flow that is directed approximately flush with the outlet wall of the respective nozzle.

5. The compressor according to claim 1, further characterized in that deflection of each nozzle is produced in the axial direction and/or the circumferential direction of the compressor.

6. The compressor according to claim 1, further characterized in that liner segment (120) is produced as a casting with each nozzle.

7. A driving mechanism or engine having a compressor according to claim 1.

8. The compressor according to claim 1, wherein a wall space between two adjacent individual nozzles (123) is smaller than the width of an individual nozzle.

9. The compressor according to claim 1, wherein five nozzles (123) form the group of nozzles in each instance.

10. A compressor having an inflow channel (110), which guides a compression medium from radially outside of a compressor housing (111) into a pressure chamber (112) formed inside the compressor housing (111), and a liner segment (120) with a plurality of groups of nozzles formed in liner segment (120) and circumferentially spaced apart along the circumference of liner segment (120), each group of nozzles having a plurality of nozzles (123) which transport the compression medium from pressure chamber (112) to a rotor having rotor blades, the plurality of individual nozzles in each respective group being aligned adjacent to one another in a circumferential direction of the liner segment;

a pocket (115) defined by a radially outwardly extending wall in the compressor housing (111);

is hereby characterized in that the plurality of nozzles (123) in liner segment (120) is positioned upstream from the rotor blades; and the rotor rotates in a circumferential direction; and each nozzle, including a deflection region, deflects the compression medium in the circumferential direction of the rotor;

wherein the pressure chamber (112) is positioned between the liner segment (120) and the compressor housing (111);

further wherein each nozzle extends from a first side of the liner segment to a second side of the liner segment, so that each nozzle (123) has an entrance section (124) in facing relation with the pocket defined the compressor housing (111), and each nozzle has an exit section (125) in facing relation with the rotor;

wherein in each nozzle the respective deflection region is located where the respective entrance section (124) and the respective exit section (125) meet; and wherein each nozzle directs the compression medium in a downstream direction; and wherein the entrance section (124) has an entrance swirling.

11. The compressor according to claim 10, further characterized in that the entrance section extends along an entrance axis, the exit section extends along an exit axis, and the entrance axis and exit axis are at an angle to one another.

12. The compressor according to claim 11, further characterized in that each nozzle has a nozzle outlet wall; and exit section (125) is configured such that the deflection between entrance section (124) and exit section (125) leads to an exit injection flow that is directed approximately flush with the nozzle outlet wall.

13. The compressor according to claim 11, further characterized in that a nozzle deflection is produced in an axial direction and/or a circumferential direction of the compressor.

14. The compressor according to claim 10, further characterized in that a wall space between two adjacent individual nozzles (123) is smaller than the width of an individual nozzle.

15. The compressor according to claim 10, further characterized in that five nozzles (123) form the group of nozzles in each instance.

16. The compressor according to claim 10, further characterized in that liner segment (120) is produced as a casting with the at least one nozzle (123).

17. A driving mechanism or engine having a compressor according to claim 10.

18. The compressor according to claim 10, wherein the exit section has an exit swirling and the entrance swirling is smaller than the exit swirling.

19. The compressor according to claim 10, wherein the plurality of groups of nozzles comprises a first group and a second group; and the first group extends along a first arc length in the circumferential direction of the liner, and the second group extends along a second arc length in the circumferential direction of the liner;

wherein the first group and the second group are spaced apart circumferentially along the liner, there is a solid liner portion without nozzles extending circumferentially between the first group and the second group, the solid liner portion extending along a solid liner portion arc length that is greater than the first arc length and that is greater than the second arc length.

* * * * *